US008219017B2

(12) United States Patent
Nakai et al.

(10) Patent No.: US 8,219,017 B2
(45) Date of Patent: Jul. 10, 2012

(54) IMAGE FORMING APPARATUS AND PROCESS CARTRIDGE

(75) Inventors: Hiroshi Nakai, Yokohama (JP); Kunio Hasegawa, Isehara (JP); Shinya Tanaka, Sagamihara (JP); Taichi Urayama, Ebina (JP)

(73) Assignee: Ricoh Company, Limited, Tokyo (JP)

( * ) Notice: Subject to any disclaimer, the term of this patent is extended or adjusted under 35 U.S.C. 154(b) by 193 days.

(21) Appl. No.: 12/656,839

(22) Filed: Feb. 17, 2010

(65) Prior Publication Data

US 2010/0209143 A1 Aug. 19, 2010

(30) Foreign Application Priority Data

Feb. 18, 2009 (JP) ..... 2009-035828

(51) Int. Cl.
*G03G 21/00* (2006.01)

(52) U.S. Cl. ..... 399/346

(58) Field of Classification Search ..... 399/123, 399/343, 346, 350, 353; 430/126.2
See application file for complete search history.

(56) References Cited

U.S. PATENT DOCUMENTS

| | | | | |
|---|---|---|---|---|
| 3,501,294 | A | 3/1970 | Joseph | |
| 7,251,437 | B2 * | 7/2007 | Tamoto et al. | |
| 2004/0165919 | A1 * | 8/2004 | Nishida | 399/346 |
| 2006/0285897 | A1 * | 12/2006 | Sugiura et al. | 399/346 |
| 2007/0183824 | A1 * | 8/2007 | Suda et al. | 399/346 |
| 2008/0118286 | A1 * | 5/2008 | Yamashita et al. | 399/346 |
| 2008/0138132 | A1 | 6/2008 | Yamashita et al. | |
| 2008/0253801 | A1 * | 10/2008 | Hatakeyama et al. | 399/113 |
| 2009/0196665 | A1 | 8/2009 | Tanaka et al. | |
| 2009/0279930 | A1 | 11/2009 | Kabata et al. | |
| 2009/0285613 | A1 | 11/2009 | Nakai et al. | |
| 2009/0290919 | A1 | 11/2009 | Tanaka et al. | |
| 2009/0290920 | A1 | 11/2009 | Hatakeyama et al. | |
| 2009/0304423 | A1 | 12/2009 | Ozaki et al. | |
| 2009/0311014 | A1 | 12/2009 | Tanaka et al. | |

FOREIGN PATENT DOCUMENTS

| | | |
|---|---|---|
| JP | 51-22380 | 7/1976 |
| JP | 2003-057996 | 2/2003 |
| JP | 3492458 | 11/2003 |
| JP | 2007-017738 | 1/2007 |
| JP | 2008-090222 | 4/2008 |
| JP | 2008-122638 | 5/2008 |

OTHER PUBLICATIONS

English language abstract of JP 09-062142, Mar. 7, 1997, corresponding to JP 3492458.

* cited by examiner

*Primary Examiner* — Sandra Brase
(74) *Attorney, Agent, or Firm* — Harness, Dickey & Pierce, PLC

(57) ABSTRACT

An image forming apparatus includes an image bearing member configured to bear a toner image, a protective layer forming device configured to apply a protective agent to a surface of the image bearing member with a brush-shaped protective agent applicator, and a surface roughness maintainer configured to maintain a surface roughness Ry of a contact surface of the protective agent with the brush-shaped protective agent applicator at 500 μm or less. The protective agent is a solid material in which a granular material comprising a fatty acid metallic salt is compressed.

14 Claims, 3 Drawing Sheets

IMAGE FORMING APPARATUS AND PROCESS CARTRIDGE

PRIORITY STATEMENT

This patent application is based on and claims priority under 35 U.S.C. §119 from Japanese Patent Application No. 2009-035828 filed on Feb. 18, 2009 in the Japan Patent Office, the entire contents of which are incorporated herein by reference.

BACKGROUND

1. Field

Example embodiments generally relate to an image forming apparatuses such as a copier, a facsimile, a printer, and a plotter. Example embodiments also relate to a process cartridge used for the image forming apparatus.

2. Discussion of the Background

In a typical electrophotographic image forming process, an electrostatic latent image is formed on an image bearing member that comprises photoconductive substances. Charged toner particles are adhered to the electrostatic latent image to form a toner image that is visible, in a process called a developing process. The toner image is finally transferred onto a transfer medium such as paper and fixed thereon by heat, pressure, or solvent vapor.

Generally, there are two types of developing methods; two-component developing methods and one-component developing methods. In a two-component developing method, toner particles are mixed with carrier particles so that the toner particles are frictionally charged. In a one-component developing method, toner particles are charged without carrier particles.

One-component developing methods are further divided into magnetic one-component developing methods and non-magnetic one-component developing methods. In a magnetic one-component developing method, a developing roller holds toner particles by magnetic force. By contrast, in a non-magnetic one-component developing method, a developing roller holds toner particles without magnetic force.

To respond to demands for high-speed image formation with high image reproducibility, the mainstream copiers and multifunctional printers have employed two-component developing methods because toner particles are reliably and quickly charged and image quality is reliable. On the other hand, to respond to demands for downsizing and cost reduction, the mainstream compact printers and facsimile machines have employed one-component developing methods.

In accordance with recent colorization of printed image, the quality of the printed image is required to be higher and more reliable.

An electrophotographic image forming apparatus generally includes an image bearing member (e.g., a photoconductor) which has a drum shape or a belt shape. The image bearing member is uniformly charged while rotating in a process called a charging process, and then exposed to a laser light beam to form a latent image thereon in a process called an exposure process. The latent image is developed into a toner image by a developing device in a process called a developing process. The toner image is transferred onto a transfer medium in a process called a transfer process.

After the transfer process, some toner particles may remain on the image bearing member without being transferred onto the transfer medium. Such residual toner particles are generally removed from the image bearing member in a process called a cleaning process so as to prevent uneven charging of the image bearing member.

Because the image bearing member receives various physical and electrical stresses through the charging, exposure, developing, transfer, and cleaning processes, the surface profile of the image bearing member is likely to vary with repeated image formation.

For example, in the cleaning process, the image bearing member receives frictional stress from a cleaning member. As a result, the surface of the image bearing member may be abraded or foreign substances may adhered thereto. Additionally, the cleaning member itself may be abraded, resulting in insufficient cleaning of the image bearing member.

In attempting to solve the above problem, one proposed approach involves reducing friction force between the image bearing member and the cleaning member. For example, Examined Japanese Patent Application Publication No. 51-22380 describes an image forming method in which a solid lubricant comprised primarily of zinc stearate is supplied to a surface of an image bearing member (i.e., a photoconductor) and formed into a thin film for the purpose of lengthening the lifespan of the image bearing member and a cleaning member.

Solid lubricants are widely used because it is easy to supply with a simple brush roller and is easy to handle. A lubricant expresses its effect only when the amount of the lubricant supplied to an image bearing member is kept constant. Therefore, various attempts have been made to reliably supply a constant amount of lubricant to a surface of an image bearing member.

For example, Unexamined Japanese Patent Application Publication No. (hereinafter "JP-A") 2008-122638 describes a lubricant applicator in which a solid lubricant is in a specific contact state with a brush roller.

JP-A 2003-057996 describes a lubricant applicator which includes a specific brush roll and a bar-like solid lubricant (hereinafter "lubricant bar") having a specific hardness. The lubricant bar is pressed against the brush roll with a predetermined pressing force.

JP-A 2008-090222 describes an image forming apparatus which includes a lubricant bar, a brush roller, and a pressing unit for pressing the lubricant bar. The pressing force varies with time so that the lubricant is constantly supplied to an image bearing member.

Both Japanese Patent No. 3492458 and JP-A 2007-017738 have made attempts to keep the supplied amount of a lubricant constant by controlling surface profile of a lubricant bar.

However, another problem is arising from the above-described attempts that toner particles are likely to adhere to a lubricant bar. (Since the lubricant generally acts like a protective agent for protecting an image bearing member, the lubricant may be hereinafter referred to as a protective agent.)

Recent toner particles are very small in size in accordance with an increasing demand for high quality image. Such small toner particles are more likely to adhere to the lubricant bar. When toner particles are adhered to the lubricant bar, it is difficult to scrape the lubricant with a brush roller, and therefore the lubricant cannot be supplied to an image bearing member. As a result, the image bearing member cannot be protected and residual toner particles cannot be efficiently removed.

SUMMARY

In view of foregoing, the example embodiments provide an image forming apparatus and a process cartridge which reliably provide high quality images for an extended period of time.

One example embodiment provides an image forming apparatus which includes an image bearing member configured to bear a toner image, a protective layer forming device configured to apply a protective agent to a surface of the image bearing member with a brush-shaped protective agent applicator, and a surface roughness maintainer configured to maintain a surface roughness Ry of a contact surface of the protective agent with the brush-shaped protective agent applicator at 500 μm or less. The protective agent is a solid material in which a granular material comprising a fatty acid metallic salt is compressed.

Another example embodiment provides a process cartridge detachably mountable on image forming apparatus, which includes an image bearing member configured to bear a toner image, a protective layer forming device configured to apply a protective agent to a surface of the image bearing member with a brush-shaped protective agent applicator, and a surface roughness maintainer configured to maintain a surface roughness Ry of a contact surface of the protective agent with the brush-shaped protective agent applicator at 500 μm or less. The protective agent is a solid material in which a granular material comprising a fatty acid metallic salt is compressed.

Additional features and advantages of example embodiments will be more fully apparent from the following detailed description, the accompanying drawings and the associated claims.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
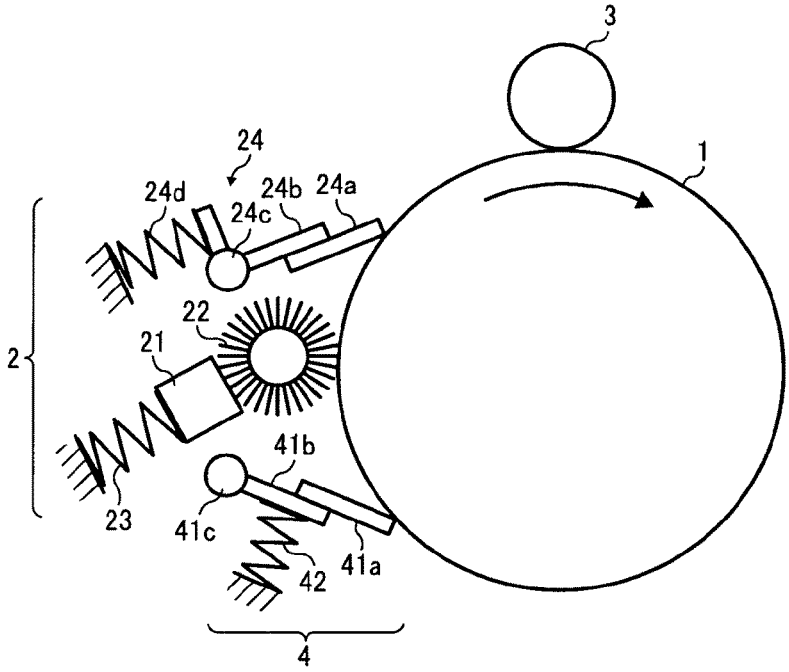
FIG. 1 is a schematic view illustrating a protective layer forming device according to example embodiments.

The inventors of the present invention have found that in some cases in which a protective agent bar is supposed to be scraped with a brush roller to be supplied to a surface of an image bearing member, disadvantageously, toner particles may fixedly adhere to a surface of the protective agent bar to prevent the protective agent bar from being scraped with the brush roller.

The above phenomenon is likely to occur when the average particle diameter of the toner particles is 5 μm or less. Even when the average particle diameter of the toner particles is 5 μm or more, the above phenomenon is likely to occur when an image with a high image area ratio is continuously produced. In this specification, the average particle diameter is the volume average particle diameter which is measured using a measuring instrument COULTER COUNTER MULTISIZER (from Beckman Coulter) equipped with an aperture having a diameter of 100 μm. The measurement sample is prepared by dispersing toner particles in an electrolyte along with a surfactant.

Additionally, the inventors of the present invention have found that the occurrence of the above phenomenon has a relation to the surface roughness of the protective agent bar, which is formed by repeated scraping with the brush roller. More specifically, the occurrence of the above phenomenon has a relation to the maximum height Ry (based on JIS (B-0601-1994)) in a surface roughness profile.

Accordingly, example embodiments provide a process cartridge detachably mountable on image forming apparatus, which includes an image bearing member configured to bear a toner image, a protective layer forming device configured to apply a protective agent to a surface of the image bearing member with a brush-shaped protective agent applicator, and a surface roughness maintainer configured to maintain a surface roughness Ry of a contact surface of the protective agent with the brush-shaped protective agent applicator at 500 μm or less. The protective agent is a solid material in which a granular material comprising a fatty acid metallic salt is compressed.

Example embodiments are described in detail below.

The protective agent has a function of protecting a surface of an image bearing member from various stresses.

The protective agent may be uniformly and quickly drawn on a surface of the image bearing member to protect the surface thereof. The protective agent may also protect a cleaning member (e.g., a cleaning blade). Accordingly, the protective agent may have lubricity. Specific preferred materials for the protective agent include, but are not limited to, inorganic lubricants, fatty acid metallic salts, waxes, oils, and fluorine-based resins. Among these materials, a mixture of an inorganic lubricant and a fatty acid metallic salt is most preferable. Each of the inorganic lubricant and the fatty acid metallic salt may be in a granular or powdered state and compressed into a solid block.

In the present specification, the inorganic lubricants are defined as inorganic compounds which can cleave by itself to lubricate or can cause inner slippage. Specific examples of such inorganic compounds include, but are not limited to, talc, mica, boron nitride, molybdenum disulfide, tungsten disulfide, kaolin, smectite, hydrotalcite compounds, calcium fluoride, graphite, platy alumina, sericite, and synthesized mica.

Among these compounds, boron nitride is most preferable because it easily cleaves and lubricates. This is because boron nitride has a structure such that plural hexagonal network-patterned layer, in which atoms are strongly bonding with each other, are overlaid one another with wide intervals and weak Van der Waal's force.

The inorganic lubricants can be subjected to surface treatments for the purpose of giving hydrophobicity, for example.

Specific examples of usable fatty acid metallic salts include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, and cadmium ricinoleate. These compounds can be used alone or in combination.

Among these compounds, zinc stearate is most preferable because it is easily formed into a film on an image bearing member.

Although zinc stearate is easy to form a film thereof, it is difficult to remove from, for example, an image bearing member when remaining thereon. In the cleaning process in which a cleaning blade removes residual toner particles from an image bearing member, it is likely that zinc stearate allows toner particles to slip through the cleaning blade. Disadvantageously, toner particles which slipped through the cleaning blade may be deposited on the resulting image or may accelerate contamination of a charging member. Toner particles are more likely to slip through the cleaning blade when the size of the toner particles is smaller. When a relatively large amount of toner particles slip through the cleaning blade, the cleaning blade may be abraded, resulting in short lifespan of the image forming apparatus. The above-described inorganic lubricants can compensate the disadvantage of zinc stearate. Therefore, it is preferable to use zinc stearate in combination with the inorganic lubricant.

Next, example methods of supplying the protective agent to a surface of an image bearing member are described below. For the purpose of effectively protecting a surface of an image bearing member, a constant amount of the powdered protective agent, each of the powder particles having substantially the same size, is applied or adhered to the surface of the image bearing member with a protective agent supply brush. Preferably, the protective agent is solid or is formed into a solid block for ease in handling.

The protective agent may be formed into a specific shape, for example, a rectangular cylinder or a circular cylinder, by a dry forming method that is one of powder forming methods.

One example of the dry forming method includes a uniaxial pressing method that includes: the first step in which a predetermined amount of a powdered or granulated protective agent (e.g., a mixture of an inorganic lubricant and a fatty acid metallic acid), each of the powder particles having substantially the same size, is weighed; the second step in which the powdered or granulated protective agent which is weighted is poured into a mold having a predetermined shape; the third step in which the powdered or granulated protective agent which is poured into the mold is compressed with a pressing mold so that a solid block (i.e., a compressed body) of the protective agent having specific continuous bubble fraction and independent bubble fraction is formed, and release the compressed body of the productive agent from the mold; and the fourth step in which the compressed body of the productive agent is optionally subjected to shape forming such as cutting, or curing for a predetermined time at a predetermined temperature followed by cooling so that binding force at interfaces of the powder particles are adjusted.

In the fourth step, in a case in which the compressed body is subjected to any shape forming, it is undesirable to perform surface smoothing by pressing a heating element against a surface of the compressed body because each powder particle of the protective agent may coalescence with each other. In a case in which the compressed body is subjected to curing, it is undesirable to perform the curing for too long a time or at too high a temperature because each powder particle of the protective agent may strongly bond with each other to bring them to an excessively-sintered state. In the excessively-sintered state, continuous bubbles in the compressed body are blocked to be transformed into independent bubbles. Therefore, the degree of binding force between the powder particles of the protective agent can be estimated from the ratio of independent bubbles. By adjusting the ratio of independent bubbles in the compressed body, excessive sintering of the powder particles can be prevented and each of the powder particles can reliably loosen.

Specific preferred embodiments of usable mold include, but are not limited to, metallic molds made of steels, stainless steels, or aluminum because they have excellent dimension accuracy and thermal conductivity. To improve releasability, inner walls of the mold may be coated with a slight amount of a release agent such as a fluorine-base resin and a silicone resin.

Example embodiments are now explained below with reference to the accompanying drawings. In the later described comparative example, example embodiment, and alternative example, for the sake of simplicity of drawings and descriptions, the same reference numerals will be given to constituent elements such as parts and materials having the same functions, and the description thereof will be omitted unless otherwise stated.

The first example embodiment of the present invention is described below with reference to FIG. 1. FIG. 1 is a schematic view illustrating a protective layer forming device according to example embodiments.

A protective layer forming device 2 is provided facing a photoconductor 1 having a drum shape that serves as an image bearing member. The protective layer forming device 2 includes a protective agent 21 including an inorganic lubricant and a fatty acid metallic salt, a protective agent supply member 22 having a brush shape, a pressing mechanism 23, and a protective layer forming mechanism 24.

The protective layer forming mechanism 24 includes a blade 24*a*, a blade support 24*b*, and a spring 24*d*. One end of the blade 24*a* is supported with the blade support 24*b* and the other end contacts a surface of the photoconductor 1 so as to trail the photoconductor 1. The blade support 24*b* is swingable on a shaft 24*c*. The spring 24*d* presses the blade support 24*b* clockwise so that a leading edge of the blade 24*a* is pressed against a circumferential surface of the photoconductor 1.

The protective agent 21 is in the form of a solid block. The pressing mechanism 23 presses the protective agent 21 against the protective agent supply member 22. The protective agent supply member 22 rotates at a linear speed different from that of the photoconductor 1 while slidably contacting a surface of the photoconductor 1. As a result, the protective agent held on the protective supply member 22 is supplied to a surface of the photoconductor 1.

In some cases, the protective agent cannot form its uniform layer only by being supplied to a surface of the photoconductor 1, depending on the kind of the protective agent. In such a case, the protective layer forming mechanism 24 assist forming a uniform protective layer.

A charging roller 3 to which a voltage including an alternating-current component is applied from a voltage applicator, not shown, is brought into contact with or close to the photoconductor 1 having a protective layer thereon. As a result, the photoconductor 1 is charged by electrical discharge occurred in a micro-gap between the charging roller 3.

Disadvantageously, a part of the protective layer may be decomposed or oxidized due to electrical stress, and discharge products in the air may contaminate a surface of the protective layer. Such a deteriorated part of the protective layer is removed by a cleaning device 4 along with other residual components remaining on the photoconductor 1.

Although the protective layer forming mechanism 24 may have a function of removing residual components from a surface of the photoconductor 1 other than a function of forming a protective layer, these functions are preferably performed separately. This is because the appropriate contact state of the blade 24*a* with the photoconductor 1 may be different from each other. Accordingly, in the present embodiment, the cleaning device 4 is provided on an upstream side from the protective agent supply member 22 relative to the direction of rotation of the photoconductor 1.

The cleaning device 4 includes a cleaning blade 41*a*, a blade support 41*b*, and a cleaning blade pressing mechanism 42 including a spring. One end of the cleaning blade 41*a* is supported with the blade support 41*b* and the other end contacts a surface of the photoconductor 1 so as to face in the direction of rotation of the photoconductor 1. The blade support 41*b* is swingable on a shaft 41*c*. The spring presses the blade support 41*b* counterclockwise so that a leading edge of the cleaning blade 41*a* is pressed against a circumferential surface of the photoconductor 1.

The pressing mechanism 23 presses the protective agent 21 against the protective agent supply member 22 so that the protective agent 21 (hereinafter also referred to as the "protective agent bar 21") is scraped off with the protective agent supply member 22.

Figure 2:
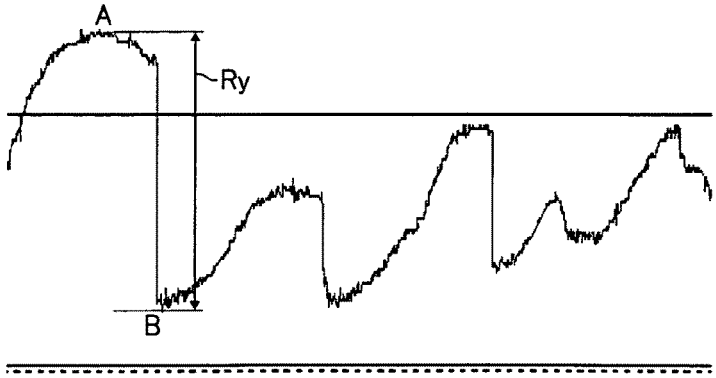
FIGS. 2 and 3 are a part of a surface profile diagram of a protective agent bar having micro grooves in the longitudinal direction according to example embodiments.
Figure 3:
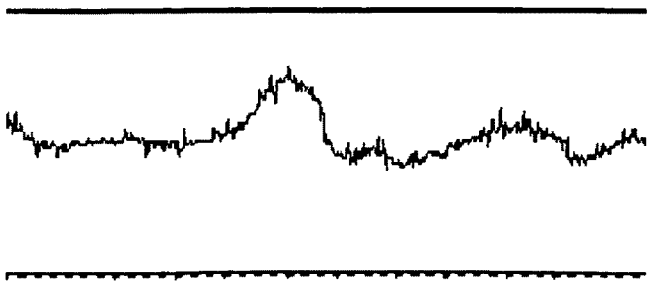

More specifically, a contact surface of the protective agent bar 21 with the protective agent supply member 22 is scraped off with the protective agent supply member 22. As a result, micro grooves (i.e., concavities) are formed on the contact surface of the protective agent bar 21. FIGS. 2 and 3 are a part of a surface profile diagram of the protective agent bar 21 having micro grooves in the longitudinal direction that is coincident with the axial direction of the photoconductor 1. In the present specification, as illustrated in FIG. 2, the surface roughness Ry is defined as a distance between the highest peak (A) and the lowest peak (B) in a surface profile diagram in the longitudinal direction of the protective agent bar.

The surface roughness Ry can be measured by observing a surface with an ultra-deep color 3D profile measuring microscope VK-9510 (from Keyence Corporation) and analyzing the surface with a profile analysis application VK-H1A9 (from Keyence Corporation) that is compliant with JIS (B 0601-1994). The surface profile diagrams illustrated in FIGS. 2 and 3 have a width of 1.5 mm. (The observation range is 1.5 mm in the longitudinal direction.)

The surface roughness Ry of the protective agent bar 21 may be constantly kept to 500 μm or less by controlling the process conditions. Alternatively, the surface roughness Ry may vary depending on the configuration of the protective agent supply member 22, the hardness of the protective agent 21, swinging manner of the protective agent supply member 22, etc. The most effective way to vary the surface roughness Ry is to vary the toner input. The toner input may dominantly contribute to the scraping condition of the protective agent bar 21. Even when the scraping condition is controlled by controlling the process conditions, the surface profile of the protective agent bar 21 may be dominantly affected by the toner.

Figure 4:
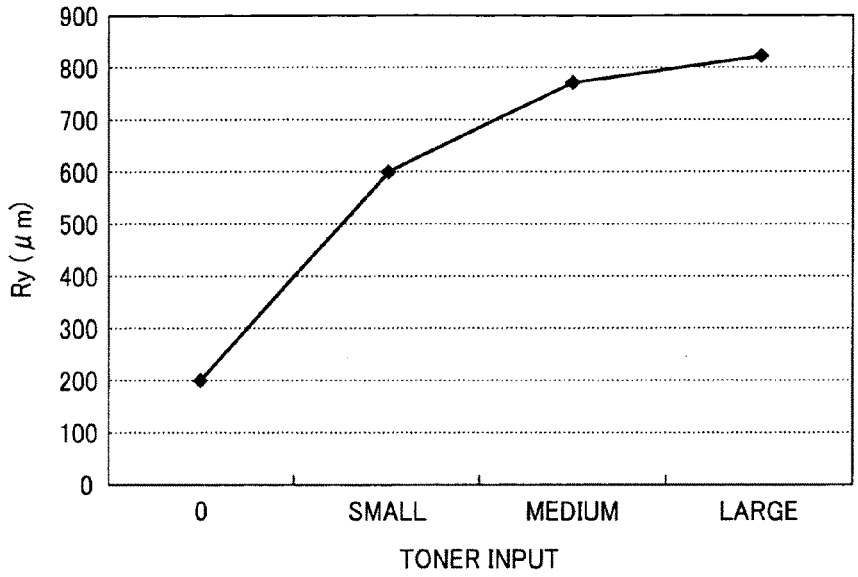
FIG. 4 is a graph showing a variation in the surface roughness Ry of a protective agent bar according to example embodiments.

FIG. 4 is a graph showing a variation in the surface roughness Ry of the protective agent bar 21. FIG. 4 is obtained under the following conditions. The protective agent bar 21 includes zinc stearate as the fatty acid metallic salt and is formed by compressing a powder of zinc stearate. The protective agent bar 21 has a uniform density. The protective agent supply member 22 is a brush including fibers made of a polyester. Each of the fiber has a fineness of 5 denir and the fiber density is 50 kF/inch$^2$, i.e., the brush includes 50,000 fibers per square inch. The input toner has a particle diameter of 6.8 μm. The Ry was measured after 2-hour driving while varying the toner input. It is clear from FIG. 4 that the Ry increases as the toner input increases. It is to be noted that increase of the Ry is gradual when the toner input exceeds a certain quantity. Therefore, the saturated amount of Ry can be estimated.

The easiest and most effective way to vary the toner input is to vary the mixing ratio of the inorganic lubricant with the fatty acid metallic salt in the protective agent bar 21 while providing the cleaning device 4 upstream from the protective layer forming device 2.

It may be said that toner particles can be more prevented from adhering to a surface of the image bearing member as the toner input decreases. On the other hand, the inventors of the present invention found that toner particles are likely to adhere to a surface of the image bearing member when the Ry exceeds 500 μm even when the toner input is small. Accordingly, it may be considered that the surface roughness Ry of the protective agent bar 21 is more dominant than the toner input in the occurrence of toner adhesion to a surface of the image bearing member.

The blade 24*a* in the protective layer forming mechanism 24 may be made of, for example, an elastic body (e.g., a urethane rubber, a hydrin rubber, a silicone rubber, and a fluorine-containing rubber) or a mixture thereof.

A portion of the rubber-made blade 24*a* which contacts the image bearing member may be coated or impregnated with a low-friction-coefficient material. To control the hardness of the blade 24*a*, either an organic filler or an inorganic filler may be dispersed therein.

The blade 24*a* is fixed on the blade support 24*b* by adhesion or fusion so that the leading edge of the blade 24*a* is pressed against a surface of the photoconductor 1. The thickness of the blade 24*a* is preferably about 0.5 to 5 mm, more preferably about 1 to 3 mm, but it may be determined considering the balance with the pressing force.

The free end that is a portion of the blade 24*a* being free from the blade support 24*b* and flexible preferably has a length of about 1 to 15 mm, more preferably about 2 to 10 mm, but it may be determined considering the balance with the pressing force.

Another embodiment of the blade 24*a* includes an elastic metallic blade (e.g., a platy spring), the surface of which is covered with a layer of a resin, a rubber, or an elastomer, optionally with a coupling agent or a primer, which is formed by coating or dipping. The layer may be further subjected to thermal hardening or surface polishing, if needed.

The elastic metallic blade preferably has a thickness of about 0.05 to 3 mm, more preferably about 0.1 to 1 mm.

To prevent twisting, the elastic metallic blade may be subjected to bending process after fixing on the blade support 24*b* so as to bend in the direction substantially parallel to the support axis.

Specific materials usable for the surface layer include, but are not limited to, a fluorine-containing resin (e.g., PFA, PTFE, FEP, PVdF), a fluorine-containing rubber, and a silicone-based elastomer (e.g., methylphenyl silicone elastomer). The surface layer may further include a filler, if needed.

To draw the protective agent on the photoconductor 1 to form a uniform protective layer thereon, the protective layer forming mechanism 24 preferably presses the photoconductor 1 with a linear pressure of from 0.05 N/cm (5 gf/cm) to 0.78 N/cm (80 gf/cm), more preferably from 0.10 N/cm (10 gf/cm) to 0.59 N/cm (60 gf/cm).

The protective agent supply member 22 is preferably in the form of a brush. To suppress mechanical stress on the photoconductor 1, fibers of the brush preferably have flexibility.

Specific examples of usable flexible materials for the brush include, but are not limited to, polyolefin resins (e.g., polyethylene, polypropylene); polyvinyl and polyvinylidene resins (e.g., polystyrene, acrylic resins, polyacrylonitrile, polyvinyl acetate, polyvinyl alcohol, polyvinyl butyral, polyvinyl chloride, polyvinyl carbazole, polyvinyl ether, polyvinyl ketone); vinyl chloride-vinyl acetate copolymers; styrene-acrylic acid copolymers; styrene-butadiene resins; fluorine-containing resins (e.g., polytetrafluoroethylene, polyvinyl fluoride, polyvinylidene fluoride, polychlorotrifluoroethylene); polyester; nylon; acrylic; rayon; polyurethane; polycarbonate; phenol resins; and amino resins (e.g., urea-formaldehyde resins, melamine resins, benzoguanamine resins, urea resins, polyamide resins). These resins can be used alone or in combination.

To adjust the degree of flexibility, for example, diene rubbers, styrene-butadiene rubbers (SBR), ethylene propylene rubbers, isoprene rubbers, nitrile rubbers, urethane rubbers, silicone rubbers, hydrin rubbers, norbornene rubbers, or mixtures thereof can be used in combination with the above materials.

The brush also includes a support. The support may be either a fixed type or a rotatable type that is in the form of a roll. One example embodiment of the brush includes a metallic bar (i.e., the support) on which a pile-woven tape is wound around in the spiral manner. The pile-woven tape contains brush fibers as the pile. Each of the brush fiber has a diameter of about 10 to 500 μm and a length of about 1 to 15 mm. The brush preferably includes 10,000 to 300,000 pieces of the brush fibers per square inch ($1.5\times10^7$ to $4.5\times10^8$ pieces of the brush fibers per square meter).

To uniformly and reliably supply the protective agent, the density of the brush fiber is preferably as high as possible. It is also preferable that each piece of the brush fiber is a bundling of several to several hundreds pieces of a micro fiber. For example, 50 pieces of a 6.7-decitex (6-denir) micro fiber May be bundled to be a 333-decitex (300-denir) brush fiber. (333 decitex=6.7 decitex×50 micro fibers, 300 denir=6 denir×50 micro fibers)

The brush fiber may have a coating layer on its surface to keep the surface profile and environmental stability constant. The coating layer preferably includes a flexible material capable of deforming depending on deflection of the brush fiber. Specific examples of usable flexible materials include, but are not limited to, polyolefin resins (e.g., polyethylene, polypropylene, chlorinated polyethylene, chlorosulfonated polyethylene); polyvinyl and polyvinylidene resins (e.g., polystyrene, acryl such as polymethyl methacrylate, polyacrylonitrile, polyvinyl acetate, polyvinyl alcohol, polyvinyl butyral, polyvinyl chloride, polyvinyl carbazole, polyvinyl ether, polyvinyl ketone); vinyl chloride-vinyl acetate copolymers; silicone resins comprised of organosiloxane bonds and modified products thereof (e.g., alkyd-modified, polyester-modified, epoxy-modified, and polyurethane-modified silicone resins); fluorine-containing resins (e.g., perfluoroalkyl ether, polyfluorovinyl, polyfluorovinylidene, polychlorotrifluoroethylene); polyamide; polyester; polyurethane; polycarbonate; amino resins (e.g., urea-formaldehyde resins); epoxy resins; and composite resins thereof.

Figure 5:
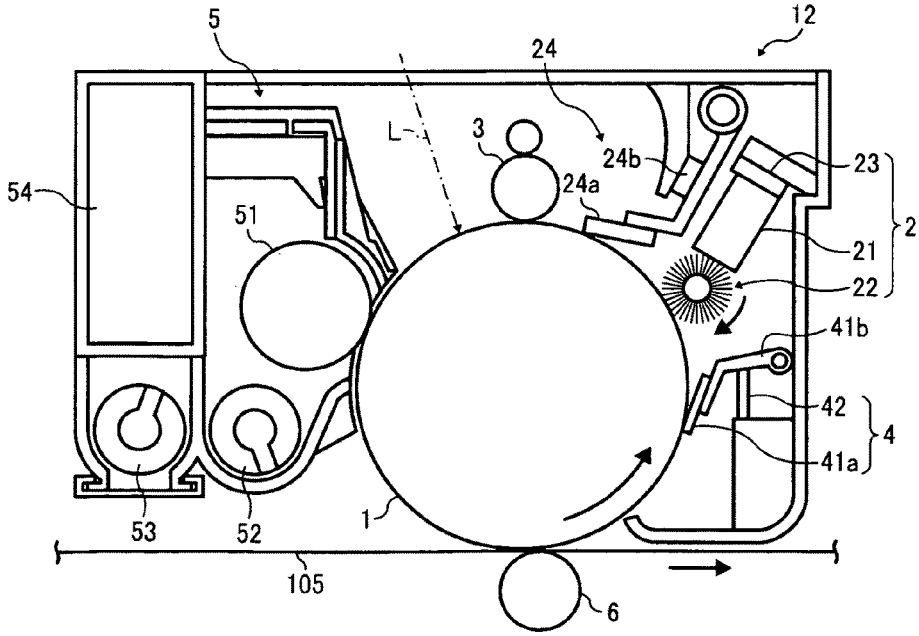
FIG. 5 is a schematic view illustrating a process cartridge according to example embodiments.

The second example embodiment of the present invention is described below with reference to FIG. 5. FIG. 5 is a schematic view illustrating a process cartridge according to example embodiments. A process cartridge 12 illustrated in FIG. 5 includes the protective layer forming device 2 according to the first example embodiment.

The process cartridge 12 includes a photoconductor 1 having a drum shape, a protective layer forming device 2, a charging roller 3, a developing device 5, and a cleaning device 4.

The developing device 5 includes a developing roller 51, conveyance screws 52 and 53 for agitating and conveying developer, and a preset case 54 for containing toner. Since the protective layer forming device 2 and the cleaning device 4 have similar configurations to those illustrated in FIG. 1, the same reference numerals are given.

The cleaning blade 41*a* removes deteriorated protective agents and residual toner particles remaining on a surface of the photoconductor 1 after the transfer process.

In FIG. 5, the cleaning blade 41*a* contacts the photoconductor 1 so as to face in the direction of rotation of the photoconductor 1.

After removing deteriorated protective agents and residual toner particles from a surface of the photoconductor 1, the protective agent supply member 22 supplies the protective agent 21 to the surface of the photoconductor 1 so that a protective layer is formed thereon by the protective layer forming mechanism 24. The photoconductor 1 having the protective layer thereon is charged by the charging roller 3 and then exposed to a laser light beam L to form an electrostatic latent image thereon. The electrostatic latent image is developed into a toner image that is visible by the developing device 5. The toner image is transferred onto an intermediate transfer belt 105 by a transfer roller 6 that is provided outside the process cartridge 12. Alternatively, the toner image is directly transferred onto a recording medium such as paper and OHP sheets.

Figure 6:
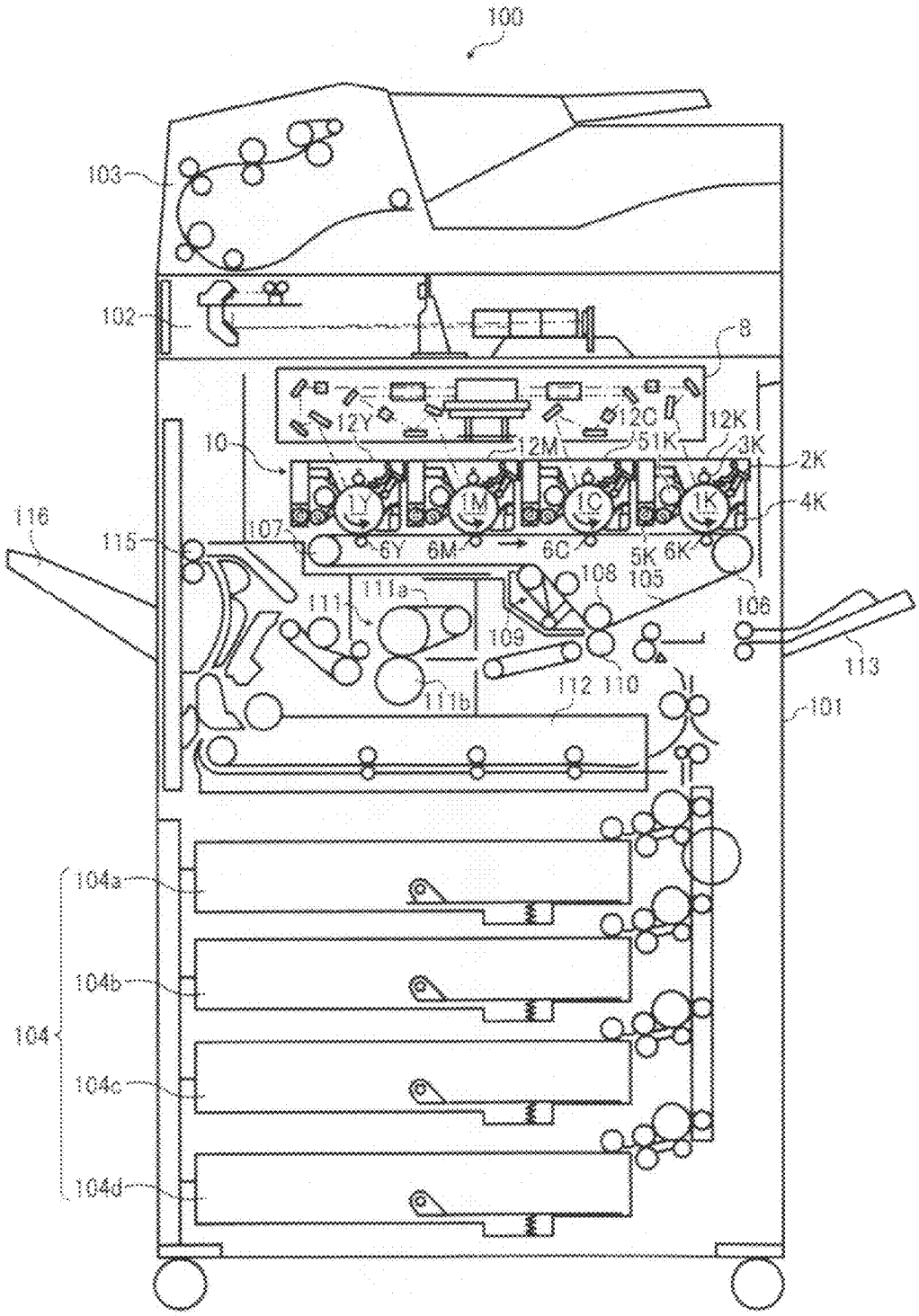
FIG. 6 is a schematic view illustrating an image forming apparatus according to example embodiments.

The third example embodiment of the present invention is described below with reference to FIG. 6. FIG. 6 is a schematic view illustrating an image forming apparatus according to example embodiments. An image forming apparatus 100 illustrated in FIG. 6 includes the protective layer forming device 2 and the process cartridge 12 according to the first and second example embodiments, respectively. The image forming apparatus 100 is a color copier employing a tandem intermediate transfer method.

The image forming apparatus 100 includes a main body 101, a scanner (an image reader) 102 provided above the main body 101, and an automatic document feeder (ADF) 103 provided above the scanner 102.

A paper feed part 104 is provided below the main body 101. The paper feed part 104 includes plural paper feed cassettes 104*a*, 104*b*, 104*c*, and 104*d*.

An intermediate transfer belt 105 is provided roughly in the center of the main body 101. The intermediate transfer belt 105 is a seamless belt that serves as an intermediate transfer member. The intermediate transfer belt 15 is stretched taut with plural support rollers 106, 107, and 108 and is driven to rotate clockwise by a driving motor, not shown.

An intermediate transfer belt cleaning device 109 for removing residual substances on the intermediate transfer belt 105 is provided adjacent to the support roller 108.

Process cartridges 12Y, 12M, 12C, and 12K are tandemly arranged in this order along a part of the conveyance path of the intermediate transfer belt 105 which is stretched taut with the support rollers 106 and 107. The process cartridges 12Y, 12M, 12C, and 12K are configured to form images of yellow, magenta, cyan, and black, respectively, and compose a tandem image forming part 10. The arrangement order of the process cartridges is not limited to the above.

The process cartridges 12Y, 12M, 12C, and 12K include respective photoconductors 1Y, 1M, 1C, and 1K having a drum shape. Around the photoconductor 1K, a protective layer forming device 2K according to the second example embodiment, a charging roller 3K, an exposure part to which a light beam L is directed from a latent image forming device 8, a developing device 5K, a transfer device 6K, and a cleaning device 4K are provided. The same are provided around the photoconductors 1C, 1M and 1Y as well.

The latent image forming device 8 is provided above the tandem image forming part 10. A secondary transfer roller 110 is provided on the opposite side of the support roller 108 relative to the intermediate transfer belt 105. The secondary transfer roller 110 transfers a toner image from the intermediate transfer belt 105 onto a sheet (e.g., paper) fed from the paper feed part 104.

A fixing device 111 is provided on the left side of the secondary transfer roller 110. The fixing device 111 is configured to fix the toner image on the sheet. The fixing device 111 includes a fixing belt 111*a* that in the form of a seamless belt and a pressing roller 111*b* pressed against the fixing belt 111*a*.

A sheet reversing device 112 is provided below the fixing device 111 nearly parallel to the tandem image forming part 10. The sheet reversing device 112 is configured to reverse a sheet when forming images on both sides of the sheet.

An example image forming process is described below. For the sake of simplicity, the additional characters Y, M, C, and K representing colors of yellow, magenta, cyan, and black, respectively, are hereinafter omitted.

First, the photoconductor 1 is neutralized by a neutralization lamp, not shown, and is negatively charged by the charging roller 3. The photoconductor 1 may be an organic photoconductor (OPC) that includes an organic photosensitive layer.

At that time, a charging voltage is applied to the charging roller 3 from a voltage application mechanism, not shown, to charge the photoconductor 1 to a desired level. The charging voltage may be overlapped with an alternating current.

The charged photoconductor 1 is exposed to a laser light beam directed from the latent image forming device 8 to form a latent image thereon. The latent image forming device 8 may be a laser optical system, for example. The absolute value of the potential in the exposed area is lower than that in the non-exposed area.

The laser light beam is emitted from a semiconductor laser and scans the photoconductor 1 in the axial direction of rotation of the photoconductor 1 with a polygon mirror that is rotating at a high speed.

The latent image is developed into a toner image with toner particles supplied from a developing roller 51.

At that time, a developing bias is applied to the developing roller 51 from a voltage application mechanism, not shown, which has a potential between the exposed-area potential and the non-exposed area potential. The developing bias may be overlapped with an alternating current.

Each of the transfer rollers 6Y, 6M, 6C, and 6K transfers each toner image from each of the photoconductors 1Y, 1M, 1C, and 1K onto the intermediate transfer belt 105 to form a composite toner image. Preferably, a transfer bias having the opposite polarity to the toner is applied to the transfer rollers 6Y, 6M, 6C, and 6K. The intermediate transfer belt 105 is then separated from the photoconductors 1Y, 1M, 1C, and 1K.

Subsequently, the secondary transfer roller 110 transfers the composite toner image from the intermediate transfer belt 105 onto a transfer sheet which is fed from the paper feed part 104 or a manual feed tray 113.

Residual toner particles remaining on the photoconductor 1 are collected with the cleaning blade 41*a* (see FIG. 4) in a toner collection chamber in the cleaning device 4.

The transfer sheet having the composite toner image thereon is conveyed to the fixing device 111 so that the composite toner image is fixed on the transfer sheet by heat and pressure. The transfer sheet on which the composite toner image is fixed is then discharged by a pair of discharge rollers 115 to be stacked on a discharge tray 116.

Alternatively, the transfer sheet on which the composite toner image is fixed is conveyed to the sheet reversing device 112 by changing conveyance path with a switching nail. The reversed transfer sheet is conveyed to the transfer area again so that an image is formed on the backside. The transfer sheet having images on both sides is then discharged by the pair of discharge rollers 115 to be stacked on the discharge tray 116.

Residual substances remaining on the intermediate transfer belt 105 are removed by the intermediate transfer belt cleaning device 109 to prepare for the next image formation in the tandem image forming area 10.

The above-described image forming apparatus employs what is called "tandem intermediate transfer method" in which plural developing device each produce different-color toner images, the different-color toner images are sequentially transferred onto an intermediate transfer member to form a composite toner image, and the composite toner image is transferred onto a transfer medium such as paper. Alternatively, the image forming apparatus according to example embodiments may employ what is called "tandem direct transfer method" in which plural developing device each produce different-color toner images, the different-color toner images are sequentially transferred onto a transfer medium such as paper.

The charging roller 3 is one example embodiment of a charger for charging an image bearing member. Suitable charger is configured to charge a charging target (i.e., an image bearing member) by being in contact with or close to a surface of the charging target. Such chargers can drastically suppress production of ozone compared to conventionally-used corotron or scorotron corona dischargers that produce ozone in a larger amount.

However, in the chargers configured to charge an image bearing member by being in contact with or close to a surface of the image bearing member, the image bearing member is likely to receive more electrical stress because discharge occurs in the vicinity of the surface of the image bearing member. By contrast, in the image forming apparatus according to example embodiments, a protective agent including an inorganic lubricant and a fatty acid metallic salt is uniformly and reliably supplied to a surface of an image bearing member, thereby suppressing deterioration of the image bearing member and reliably producing high quality images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Protective Agents

To prepare protective agents 1 to 4, an inorganic lubricant (A) and a fatty acid metallic salt (B) were mixed as described in Table 1. The mixing was performed using a WONDER BLENDER WB-1 (from Osaka Chemical Co., Ltd.) for 10 seconds at 25,000 rpm. This mixing operation was repeated twice.

TABLE 1

| | Inorganic Lubricant (A) | | Fatty Acid Metallic Salt (B) | |
|---|---|---|---|---|
| | Chemical Species | Quantity (parts) | Chemical Species | Quantity (parts) |
| Agent 1 | — | 0 | Zinc Stearate | 100 |
| Protective Agent 2 | Boron Nitride | 10 | Zinc Stearate | 90 |
| Protective Agent 3 | Boron Nitride | 20 | Zinc Stearate | 80 |
| Protective Agent 4 | Boron Nitride | 30 | Zinc Stearate | 70 |

An aluminum mold having a depth of 20 mm, a width of 8 mm, and a length of 350 mm was filled with each of the mixture powders. After evening out the surface with a spatula, the mixture powder was compressed with a pressing mold so as to have a height of 8 mm. Thus, solid blocks (i.e., compressed bodies) of the protective agents 1 to 4 were prepared. The amount of the mixture powder poured in the aluminum mold was controlled so that the resulting compressed body had a filling fraction of 90%. Specifically, the amount of the mixture powder to be poured in the aluminum mold is equal to the product of the volume of the mold, the absolute specific gravity of the mixture powder, and 0.9.

Each of the solid blocks was released from the mold and formed into a rectangular cylinder with a thickness of 8 mm and a width of 8 mm, in the direction of scraping of the protective agent with a protective agent supply brush, and a length of 310 mm, in the longitudinal (axial) direction of an image bearing member. Each of the solid blocks was adhered to a metallic support with a double-faced tape. Thus, protective agent bars 1 to 4 were prepared.

Preliminary Experiments 1 to 18

A pseudo process cartridge was prepared by removing all elements which perform charging, light exposure, or transfer from the process cartridge 12 illustrated in FIG. 5. Each combination of protective agent bar and protective agent supply brush was set in the pseudo process cartridge as described in Table 2-1 and, the pseudo process cartridge was driven for 10 hours.

The cleaning blade 41*a* had been preliminary deteriorated by producing 100,000 sheets of an image so as to allow toner particles to slip through the cleaning blade more easily. In Preliminary Experiment 12, the protective agent bar was swung in the longitudinal direction at an arbitrary timing so as to prevent formation of concavities and convexities on a surface of the protective agent bar.

The surface roughness Ry of the protective agent bar and the adhesion state of toner to the protective agent bar after the 10-hour driving are described in Table 2-2. Toner adhesion states are graded into the following 3 levels.

A: No toner particle was adhered. Practically usable.

B: Toner particles were slightly adhered. Allowable.

C: Toner particles were considerably adhered. Unusable.

TABLE 2-1

| | | Protective Agent Supply Brush | | | Toner | |
|---|---|---|---|---|---|---|
| Preliminary Experiment No. | Protective Agent Bar | Material | Fiber Fineness (denir) | Fiber Density (kF/inch$^2$) | Volume Average Particle Diameter (μm) | Main Resin |
| 1 | 1 | Polyester | 5 | 100 | 5.2 | Polyester |
| 2 | 1 | Polyester | 10 | 50 | 5.2 | Polyester |
| 3 | 1 | Acryl | 20 | 20 | 5.2 | Polyester |
| 4 | 1 | Polyurethane | 5 | 75 | 5.2 | Polyester |
| 5 | 1 | Polyester | 5 | 100 | 5.2 | Polyol |
| 6 | 1 | Polyester | 5 | 100 | 5.2 | Polystyrene |
| 7 | 1 | Polyester | 5 | 100 | 4.5 | Polyester |
| 8 | 1 | Polyester | 10 | 50 | 4.5 | Polyester |
| 9 | 2 | Polyester | 5 | 100 | 4.5 | Polyester |
| 10 | 3 | Polyester | 5 | 100 | 4.5 | Polyester |
| 11 | 4 | Polyester | 5 | 100 | 4.5 | Polyester |
| 12* | 1 | Polyester | 10 | 50 | 4.5 | Polyester |
| 13 | 1 | Polyester | 5 | 50 | 6.8 | Polyester |
| 14 | 1 | Polyester | 5 | 50 | 5.2 | Polyester |
| 15 | 1 | Nylon | 5 | 50 | 5.2 | Polyester |
| 16 | 1 | Polyester | 5 | 50 | 4.5 | Polyester |
| 17 | 1 | Polyester | 3 | 100 | 4.5 | Polyester |
| 18 | 4 | Polyester | 3 | 100 | 4.5 | Polyester |

*In Experiment 12, the protective agent bar is swung in the longitudinal direction at an arbitrary timing.

TABLE 2-2

| | Results | |
|---|---|---|
| Preliminary Experiment No. | Ry (μm) | Toner Adhesion |
| 1 | 420 | B |
| 2 | 380 | B |
| 3 | 340 | B |
| 4 | 440 | B |
| 5 | 400 | B |
| 6 | 400 | A |
| 7 | 340 | B |
| 8 | 330 | B |
| 9 | 250 | A |
| 10 | 200 | A |
| 11 | 110 | A |
| 12 | 140 | A |
| 13 | 900 | C |
| 14 | 860 | C |
| 15 | 1040 | C |
| 16 | 670 | C |
| 17 | 610 | C |
| 18 | 550 | C |

It is clear that the Ry value at the termination of the experiment is the maximum because the Ry generally increases as the toner input increases. Therefore, Experiments 13 to 18, in which the Ry is 550 μm or above and the toner adhesion state is C, are beyond the scope of the present invention while Experiments 1 to 12 are within the scope of the present invention.

It should be noted that the product of the fiber fineness (denir) and the fiber density (kF/inch$^2$) is 375 or above in Experiments 1 to 12 while it is 300 or below in Experiments 13 to 18.

Accordingly, it may be said that the product of the fiber fineness (denir) and the fiber density (kF/inch$^2$) represents an ability of the protective agent supply brush to abrade a surface of the protective agent bar.

Examples 1 to 11

A process cartridge having a similar configuration to the process cartridge 12 illustrated in FIG. 5 was prepared. Specifically, the photoconductor 1 was a drum-shaped photoconductor having a diameter of 40 mm, the charging roller 3 was a hard resin roller having a diameter of 12 mm, the gap between the photoconductor 1 and the charging roller 3 was 50 μm, and the blade 24*a* was in contact with the photoconductor 1 so as to face in the direction of rotation of the photoconductor 1. Each developer that was a mixture of 7% by weight of each toner used in Preliminary Experiments 1 to 11 and 93% by weight of a carrier having a diameter of 35 μm was set in the developing device 5. Each combinations of protective agent bar and protective agent supply brush used in Preliminary Experiments 1 to 11 was also set in the process cartridge.

The process cartridge was mounted on a modified full-color multifunctional printer IMAGIO MP C3500 (from Ricoh Co., Ltd.) and a running test in which 100,000 sheets of an A4-size document having an image area ratio of 20% are continuously produced was performed. The charging process was performed by applying an alternating electric field in which a direct current with a voltage of −600 V is overlapped with an alternating current which is a sine wave with a Vpp of 3 kV and a frequency of 1.5 kHz. After the termination of the running test, the Ry of the protective, agent bar was measured and toner adhesion state to the protective agent bar was determined by visual observation. Additionally, the photoconductor is visually observed to determine whether toner and/or protective agent form undesired films thereon or not. (This phenomenon is hereinafter referred to as "photoconductor filming".)

Further, after the termination of the running test, an image was produced at 10° C., 15% RH (i.e., under a low-temperature and low-humidity condition) and was visually observed to determine the degree of cleaning of the photoreceptor.

Example 12

The procedure in each Examples 1 to 11 is repeated except that the combination of protective agent bar, protective agent supply brush, and toner was changed to that of Preliminary Experiment 12 and a swing mechanism for swinging the protective agent bar in the longitudinal direction of the protective agent supply brush at every 100 sheets was provided.

Comparative Examples 1 to 6

The procedure in Examples 1 to 11 was repeated except that the combination of protective agent bar, protective agent supply brush, and toner was changed to those of Preliminary Experiments 13 to 18.

The evaluation results of Examples 1 to 12 and Comparative Examples 1 to 6 are shown in Table 3. In Table 3, the results in "Toner Adhesion", "Photoconductor Filming", and "Cleaning under LL (low-temperature and low-humidity) Condition" are graded as follows.

A: Very Excellent. Practically usable.
B: Practically usable.
C: Allowable.
D: Unusable.

TABLE 3

| | After Running test | | | |
|---|---|---|---|---|
| | Protective Agent Bar | | | Cleaning |
| | Ry (μm) | Toner Adhesion | Photoconductor Filming | under LL Condition |
| Example 1 | 450 | C | C | B |
| Example 2 | 360 | C | B | B |
| Example 3 | 300 | C | B | C |
| Example 4 | 470 | C | B | A |
| Example 5 | 430 | C | B | A |
| Example 6 | 410 | B | A | A |
| Example 7 | 340 | C | C | B |
| Example 8 | 330 | C | B | B |
| Example 9 | 250 | B | A | A |
| Example 10 | 210 | B | A | A |
| Example 11 | 140 | A | A | A |
| Example 12 | 300 | C | B | B |
| Comparative Example 1 | 1050 | D | D | B |
| Comparative Example 2 | 900 | D | D | D |
| Comparative Example 3 | 1120 | D | D | D |
| Comparative Example 4 | 650 | D | D | D |
| Comparative Example 5 | 600 | D | D | D |
| Comparative Example 6 | 580 | D | D | C |

It is clear from Tables 2-1, 2-2, and 3 that each Preliminary Experiments 1 to 12 and each corresponding Examples 1 to 12 have substantially the same results. It is also clear that the results do not depends on the kind of the used toner.

In Examples 1 to 12, the occurrence of toner adhesion, photoconductor filming, and insufficient cleaning are suppressed because the surface roughness Ry of the protective agent bar is kept to 500 μm or less.

In Examples 9 to 11, better results have obtained because the protective agent bar includes both boron nitride as an inorganic lubricant and zinc stearate a fatty acid metallic salt.

Without swing mechanism, Example 8 delivered substantially the same results as Example 12 having the swing mechanism. It is clear from this fact that the cleaning device that is provided upstream from the protective layer forming device relative to the direction of movement of the image bearing member have a sufficient ability to keep the Ry to 500 μm or less.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

an image bearing member configured to bear a toner image;

a protective layer forming device configured to apply a protective agent to a surface of the image bearing member with a brush-shaped protective agent applicator, the protective agent being a solid material in which a granular material comprising a fatty acid metallic salt is compressed, and the protective agent containing bubbles; and a surface roughness maintainer configured to maintain a surface roughness Ry of a contact surface of the protective agent with the brush-shaped protective agent applicator at 500 μm or less.

2. The image forming apparatus according to claim 1, wherein the surface roughness maintainer is a cleaning device provided upstream from the protective layer forming device relative to the direction of movement of the image bearing member, configured to remove residual toner particles remaining on a surface of the image bearing member by slidably contact with the image bearing member.

3. The image forming apparatus according to claim 1, wherein the surface roughness maintainer is the brush-shaped protective agent applicator which includes plural fibers, and a product of a fineness (denir) of each fiber and a density of the fibers (kF/inch$^2$) is 350 or more.

4. The image forming apparatus according to claim 1, wherein the granular material further comprises an inorganic lubricant.

5. The image forming apparatus according to claim 4, wherein the inorganic lubricant is boron nitride.

6. The image forming apparatus according to claim 5, wherein the fatty acid metallic salt is zinc stearate.

7. The image forming apparatus according to claim 1, wherein the fatty acid metallic salt is zinc stearate.

8. A process cartridge detachably mountable on image forming apparatus, comprising:

an image bearing member configured to bear a toner image;

a protective layer forming device configured to apply a protective agent to a surface of the image bearing member with a brush-shaped protective agent applicator, the protective agent being a solid material in which a granular material comprising a fatty acid metallic salt is compressed, and the protective agent containing bubbles; and a surface roughness maintainer configured to maintain a surface roughness Ry of a contact surface of the protective agent with the brush-shaped protective agent applicator at 500 μm or less.

9. The process cartridge according to claim 8, wherein the surface roughness maintainer is a cleaning device provided upstream from the protective layer forming device relative to the direction of movement of the image bearing member, configured to remove residual toner particles remaining on a surface of the image bearing member by slidably contact with the image bearing member.

10. The process cartridge according to claim 8, wherein the surface roughness maintainer is the brush-shaped protective agent applicator which includes plural fibers, and a product of a fineness (denir) of each fiber and a density of the fibers (kF/inch$^2$) is 350 or more.

11. The process cartridge according to claim 8, wherein the granular material further comprises an inorganic lubricant.

12. The process cartridge according to claim 11, wherein the inorganic lubricant is boron nitride.

13. The process cartridge according to claim 12, wherein the fatty acid metallic salt is zinc stearate.

14. The process cartridge according to claim 8, wherein the fatty acid metallic salt is zinc stearate.

* * * * *